US010753182B2

(12) United States Patent
Cargol, Jr. et al.

(10) Patent No.: US 10,753,182 B2
(45) Date of Patent: Aug. 25, 2020

(54) SUBSEA CONNECTION SYSTEM FOR CONNECTING A HOT STAB OF A FLOWLINE TO A SUBSEA STRUCTURE

(71) Applicant: TRENDSETTER ENGINEERING, INC., Houston, TX (US)

(72) Inventors: Patrick Michael Cargol, Jr., Houston, TX (US); Mario R. Lugo, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 146 days.

(21) Appl. No.: 15/678,803

(22) Filed: Aug. 16, 2017

(65) Prior Publication Data

US 2019/0055822 A1 Feb. 21, 2019

(51) Int. Cl.

| | |
|---|---|
| ***E21B 43/01*** | (2006.01) |
| ***E21B 19/00*** | (2006.01) |
| ***E21B 41/04*** | (2006.01) |
| ***E21B 41/06*** | (2006.01) |
| ***E21B 41/08*** | (2006.01) |
| ***E21B 43/013*** | (2006.01) |

(52) U.S. Cl.

CPC ..... *E21B 43/0107* (2013.01); *E21B 19/002* (2013.01); *E21B 41/04* (2013.01); *E21B 41/06* (2013.01); *E21B 41/08* (2013.01); *E21B 43/013* (2013.01); *E21B 43/0122* (2013.01)

(58) Field of Classification Search

CPC ..... E21B 43/0107; E21B 19/002

See application file for complete search history.

(56) References Cited

U.S. PATENT DOCUMENTS

| | | | | |
|---|---|---|---|---|
| 4,525,101 A * | 6/1985 | Stevens | F16L 1/26 | 405/169 |
| 4,643,614 A * | 2/1987 | Laursen | E21B 17/015 | 166/350 |
| 4,784,525 A * | 11/1988 | Francois | B63C 11/52 | 166/338 |
| 5,129,460 A * | 7/1992 | Ritter, Jr. | E21B 33/037 | 166/368 |
| 5,593,249 A * | 1/1997 | Cox | E21B 41/04 | 405/169 |
| 5,730,551 A * | 3/1998 | Skeels | E21B 43/0135 | 166/343 |
| 6,234,717 B1 * | 5/2001 | Corbetta | E21B 41/04 | 405/158 |

(Continued)

*Primary Examiner* — Matthew R Buck
*Assistant Examiner* — Aaron L Lembo
(74) *Attorney, Agent, or Firm* — Egbert Law Offices, PLLC

(57) ABSTRACT

A subsea connection system has a subsea structure with a flow channel therein and a port at one end of the flow channel, a stab having a flowline connected thereto, and a frame affixed to the stab. The stab is adapted to engage the port of the subsea structure so as to allow a fluid to flow from the flowline into the flow channel. The frame has a hook portion that is engageable with a tool hanger of the subsea structure so as to support the stab in alignment with the port. The frame is pivotable about the tool hanger so as to move the stab toward the port. An actuator is cooperative with the stab so as to move the stab between a retracted position and an extended position.

8 Claims, 6 Drawing Sheets

(56) References Cited

U.S. PATENT DOCUMENTS

| | | | | |
|---|---|---|---|---|
| 6,463,801 | B1 * | 10/2002 | Young | E02D 1/04 73/170.32 |
| 6,805,382 | B2 * | 10/2004 | Jennings | F16L 37/002 166/341 |
| 6,997,645 | B2 * | 2/2006 | von Trepka | F16L 1/26 405/169 |
| 7,225,877 | B2 * | 6/2007 | Yater | B63B 27/34 166/338 |
| 7,402,000 | B2 * | 7/2008 | Bastesen | E21B 43/0107 166/342 |
| 7,806,187 | B2 | 10/2010 | Lugo | |
| 8,057,126 | B2 * | 11/2011 | Mogedal | F16L 1/26 405/169 |
| 8,388,363 | B2 | 3/2013 | Karlsan et al. | |
| 8,418,766 | B2 * | 4/2013 | Luppi | E21B 43/013 166/338 |
| 8,794,336 | B2 * | 8/2014 | Bekkevold | F16L 1/26 166/380 |
| 8,931,562 | B2 * | 1/2015 | Cargol, Jr. | E21B 43/0122 166/344 |
| 8,985,219 | B2 | 3/2015 | Cruden | |
| 9,163,485 | B2 * | 10/2015 | White | E21B 43/013 |
| 9,243,462 | B2 | 1/2016 | Gutierrez et al. | |
| 2006/0219412 | A1 * | 10/2006 | Yater | B63B 27/34 166/346 |
| 2013/0146301 | A1 | 6/2013 | Lugo | |
| 2017/0082230 | A1 * | 3/2017 | Price | F16L 37/33 |

* cited by examiner

SUBSEA CONNECTION SYSTEM FOR CONNECTING A HOT STAB OF A FLOWLINE TO A SUBSEA STRUCTURE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to a subsea connection systems that allow fluid to flow between a flowline and a subsea structure. More particularly, the present invention relates to stabs that can be joined to ports of a flow channel of a subsea structure. More particularly, the present invention relates to the connection of high-volume flowlines to a flow channel of a subsea structure, such as a relief well injection spool.

2. Description of Related Art Including Information Disclosed Under 37 CFR 1.97 and 37 CFR 1.98

In producing oil and gas from offshore wells, a wellhead is employed at the sea floor to regulate and direct the flow of hydrocarbons from the reservoir, through tubular risers, and to the surface where fluids are collected in a receiving facility located on a platform or other vessel. Normally, the flow of hydrocarbons is controlled via a series of valves installed on the wellhead, the risers, and the receiving facility at the surface. Other subsea equipment, such as manifolds and pipelines, also assist in directing the produced fluids.

Flowlines are used to interconnect pieces of subsea oilfield equipment for fluid communication. These flowlines generally take the form of somewhat flexible armoured hoses or pipes, provided with subsea matable connectors at either end. Typically, they are installed by being lowered into place from a pipe-laying vessel, with the final positioning and make-up of the end connectors carried out by divers or by remotely-operated vehicles (ROVs). Short ROV-installable hoses and pipes are used to interconnect adjacent pieces of subsea equipment. Examples of subsea equipment that may be interconnected using flowlines include subsea Christmas trees, manifolds, capping stacks, blowout preventers, or other subsea structures that require hydraulic connections. This equipment is located on the seabed.

When there are several different pieces of equipment to be interconnected, installation of the necessary pipes and flowlines can be time-consuming. An end of each flowline is generally lowered vertically to the seabed from a pipe-laying vessel. The flowline is then laid out horizontally between the points to be interconnected. The flowline ends must then be retrieved from the seabed by an ROV. The end connectors are aligned with the subsea equipment for make-up of the required fluid-tight connections.

A known type of flowline has a first part mounted to a piece of subsea equipment, such as a wellhead, and a mating second part fitted to the end of a flowline. In use, the second part is lowered toward the seabed and is stabbed from above into the first part. A pivot arrangement then guides the second part and attached flowline so as to hinge over into a generally horizontal position, in which the flowline may be laid away along the seabed, and in which the connector's first and second mating parts are axially aligned for make-up of a fluid-tight connection.

In order to connect various flowlines to items of equipment on the ocean floor, special connectors known as "flying leads" are often employed. The flying leads connect the ends of lines to subsea equipment, such as connecting to a control pod on a manifold or subsea tree at one end and to an umbilical termination assembly at the other end. In shallow waters, flying leads are connected the subsea equipment by divers. In deeper waters, one or more remotely-operated vehicles (ROVs) are utilized.

One of the problems with the existing systems is that, while they are effective for small bores of less than two inches, they are extremely difficult to install with respect to large bore applications (greater than two inches). In these large bore applications, the large pressures involved tend to create greater separation pressures. As such, they would generally be ineffective in supporting the connection under the effect of great pressures. As such, a need has developed so as to provide a subsea flowline connection assembly which can be used for large bore applications and which can withstand the great pressures involved in such applications.

Recently, there have been a great emphasis in the efforts to address the problems associated with well blowouts. Under the circumstances of a well blowout, the hydrocarbons from the well flow uncontrollably out of the wellhead. As such, it is been mandated that relief wells be prepared so as to address the potential of the blowout. The relief well extends from another wellhead at the seabed in a direction toward the hydrocarbon-producing wellbore. So as to stop the blowout, a high pressure fluid is directed through the relief well to the wellbore. The pressure of the fluid entering the wellbore should be sufficient to overcome the pressures in the reservoir formation and the pressure of the fluid flowing outwardly of the wellhead. As such, the present Applicant has developed a relief well injection spool so as to provide a connection with the wellhead of the relief well and the bore of the relief well.

This relief well injection spool, as described in U.S. application Ser. No. 15/335,805, is affixed to the relief well wellhead and includes a bore therein, along with flow channels that open to the bore from opposite sides of the relief well injection spool. These flow channels allow high-pressure fluid to be introduced into the bore of the relief well injection spool and, thereby, into the relief well.

In those applications where very high pressure fluids in the reservoir must be addressed, it is necessary to introduce high-volume and high-pressure fluids into the relief well injection spool. As such, it is necessary to install a four inch inner diameter flowline to the relief well injection spool. A hot stab connected with such a very large flowline is extremely heavy. As such, it would be too heavy to manipulate with an ROV. A very complex procedure would be required so as to properly install a very heavy hot stab to the port of the flow channel of the relief well injection spool. As such, a need has developed so as to facilitate the ability to install the large diameter flowline to the flow channel of the relief well injection spool. It is important to be able to remove the weight of such a hot stab from the ROV so as to allow for proper installation.

In the past, various patents have issued with respect to such hot stab assemblies. For example, U.S. Pat. No. 7,806,187 to the present Applicant, describes a connector assembly for connecting a hot stab to a hydraulic hose. The hot stab has a fluid conduit connector thereon. A hydraulic hose having a connector assembly at an end thereof is suitable for joining to the fluid conduit connector of the hot stab. A sleeve is affixed to the hot stab and to the hydraulic hose so as to extend over and surround the fluid conduit connector and the connector assembly. A jam nut is affixed to the tubular portion of the fluid conduit connector. The sleeve is threadedly connected to the threaded exterior surface of the jam nut. A crimped fitting is secured to an end of the hydraulic hose. A hose swivel extends around the crimped fitting and is affixed around the fluid conduit connector of the hot stab.

U.S. Pat. No. 8,388,363, issued on Mar. 5, 2013 to Karlsan et al., describes a connector assembly for connecting and/or disconnecting a conduit to or from a subsea pipeline. This a connector assembly includes a female cone element, a complementary male cone element, and a bolt tightening means. The tightening means includes a first stab member adapted to be received in a first receptacle in the female cone element. The first receptacle has an opening facing in an opposite direction of the cone of the female cone element for receiving the first stab member. A tightening bolt is provided in the first stab member within an inner end of the bolt by being adapted to engage the male cone element and with an outer end being accessible for the connecting and/or disconnecting operations.

U.S. Pat. No. 8,985,219, issued on Mar. 24, 2015 to K. D. Cruden, shows a system and method for connection and installation of underwater lines. This technique is intended to facilitate the formation of subsea connections. A free end of a stab connection system is moved into proximity with a fixed portion of the stab connection system at a subsea location. The free portion is initially engaged with the fixed portion via a docking probe. Subsequently, a local actuator is used to draw the free portion into an operating engagement with the fixed portion in which line couplers of the fixed portion are engaged with corresponding line couplers of the free portion.

U.S. Pat. No. 9,243,462, issued on Jan. 26, 2016 to Gutierrez et al., provides a high flow hot stab connection. The body of the connector has a first portion and a connection profile portion. A first port is formed through an outer surface of the first portion. A plurality of openings are formed through an outer surface of the connection profile portion. A plurality of fluid passageways extend through the body and are coupled between the first port and the plurality of openings. The subsea fluid connector can have a first fluid flow path extending through the plurality of fluid passageways between the first port through the outer surface of the first portion and the plurality of openings through the outer surface of the connection profile portion. A second fluid flow path extends through a fluid passage between a second port to the outer surface of the first portion and a third port through the outer surface of the connection profile portion.

U.S. Patent Application Publication No. 2013/0146301, published on Jun. 13, 2013 to the present Applicant, describes a subsea flowline connection assembly for use with a subsea structure. A junction plate is affixed to the subsea structure so as to support a flowline connector thereon. A receptacle is affixed to or adjacent to the junction plate. A fly-in connector assembly has a connector thereon. The connector of the fly-in connector assembly is engaged with the flowline connector of the junction plate. The fly-in connector assembly has a flow passageway in communication with the connector of the fly-in connector assembly. The receptacle has at least one slot form therein. The fly-in connector assembly has an insert member slidably received by the slot. The fly-in connector assembly has an actuator coupled to the connector thereof so as to allow an ROV to rotate an end effector so as to move the connector of the fly-in connector assembly toward the flowline connector.

It is an object of the present invention to provide a subsea flowline connection system and method which allows large diameter flowlines to be connected to a subsea structure.

It is another object of the present invention to provide a subsea flowline connection system which does not require an ROV to support the weight of the stab connection system.

It is another object of the present invention to provide a subsea flowline connection system and method which allows a large diameter flowline to be quickly and easily connected to the subsea structure.

It is still another object of the present invention to provide a subsea flowline connection system and method which allows high pressure and high volume fluids to be delivered to a relief well through a relief well injection spool.

It is still another object of the present invention to provide a subsea flowline connection system and method which assures a positive and fixed connection between the stab and the flow channel of the subsea structure.

It is still another object of the present invention to provide a subsea flowline connection system and method which allows the hot stab to be easily removed from the subsea structure.

It is still a further object of the present invention to provide a subsea flowline connection system which allows the connection system to be easily removed from the subsea structure and then transported for use elsewhere.

It is still further object of the present invention to provide a subsea flowline connection system and method that can be quickly deployed in emergency conditions.

These and other objects and advantages of the present invention will become apparent from a reading of the attached specification and appended claims.

BRIEF SUMMARY OF THE INVENTION

The present invention is a subsea connection system that comprises a subsea structure having a flow channel therein, a stab having a flowline connected thereto, and a frame affixed to the stab. The flow channel has a port adjacent one end thereof. The subsea structure has a tool hanger positioned on an outer surface thereof adjacent to the port. The stab is adapted to engage the port of the subsea structure so as to allow a fluid to flow from the flowline into the flow channel of the subsea structure. The frame has a hook portion that is engageable with the tool hanger of the subsea structure so as to support the stab in alignment with the port of the flow channel. The frame is pivotable about the tool hanger so as to move the stab toward the port.

In the subsea connection system of the present invention, an actuator is positioned on the frame and is cooperative with the stab. The actuator is adapted to move the stab between a retracted position and an extended position. The extended position connects the stab to the port. In particular, the actuator can be a hydraulic actuator. This hydraulic actuator has a pair of ports opening outwardly thereof. One of the pair of ports of the hydraulic actuator is adapted to allow a remotely-operated vehicle to move the stab from the retracted position to the extended position. The other of the pair of ports of the hydraulic actuator is adapted to allow the remotely-operated vehicle to move the stab from the extended position to the retracted position.

A lock member is affixed to the frame. The lock member is engageable with the subsea structure so as to fix a position of the frame with respect to the port of the subsea structure. This lock member has a receptacle on either the subsea structure or the frame and a pin on the other of the subsea structure and the frame. The pin is rotatable so as to engage the receptacle. As such, the frame is locked to the subsea structure.

The flowline that is connected to the stab of the present invention has a diameter of greater than two inches. In the preferred embodiment the present invention, the flowline will have a four inch inner diameter. Also, in the preferred embodiment the present invention, the subsea structure is a relief well injection spool. A line can be affixed to the frame and extend upwardly therefrom. The line is payable so as to cause the frame to pivot about the tool hanger and the subsea structure.

The present invention is also a method of connecting a stab to a port of a flow channel of a subsea structure. This method includes the steps of: (1) lowering the frame and the stab toward the subsea structure; (2) pivoting the frame with respect to the subsea structure such that the stab is in proximity to the port of the subsea structure; and (3) actuating the stab within the frame so that the stab moves from a retracted position to an extended position. The extended position engages the port of the subsea structure so as to establish a fluid connection between the flowline and the flow channel.

The method of the present invention also includes moving the lowered frame and the stab to a position such that the hook portion is received by the tool hanger. The hook portion is rotated with respect to the tool hanger. The frame is locked to the subsea structure after the step of pivoting. In particular, a locking pin of the locking pin of the frame is engaged with a receptacle on the subsea structure.

In the method of the present invention, the step of actuating includes connecting a remotely-operated vehicle to a hydraulic actuator and flowing hydraulic fluid from the remotely-operated vehicle to the hydraulic actuator so as to move the stab from the retracted position to the extended position. The hydraulic actuator is affixed to the frame and is cooperative with the stab.

In the method of the present invention, the frame is connected to a line. The step of lowering includes paying out the line from a surface location until the frame and the stab are in proximity to the subsea structure. The line is further payed out from the surface location until the line becomes slack. This completes the step of pivoting. The flowline is connected to the stab so as to establish a fluid connection between the flowline and the stab. The flowline will have an inner diameter greater than two inches. Fluid can flow through the flowline and through the stab into the channel of the subsea structure. After completion of the operations, the stab is retracted within the frame so as to separate the stab from the port of the subsea structure, the frame is unlocked from the subsea structure, and then the frame and the stab are raised toward a surface location.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
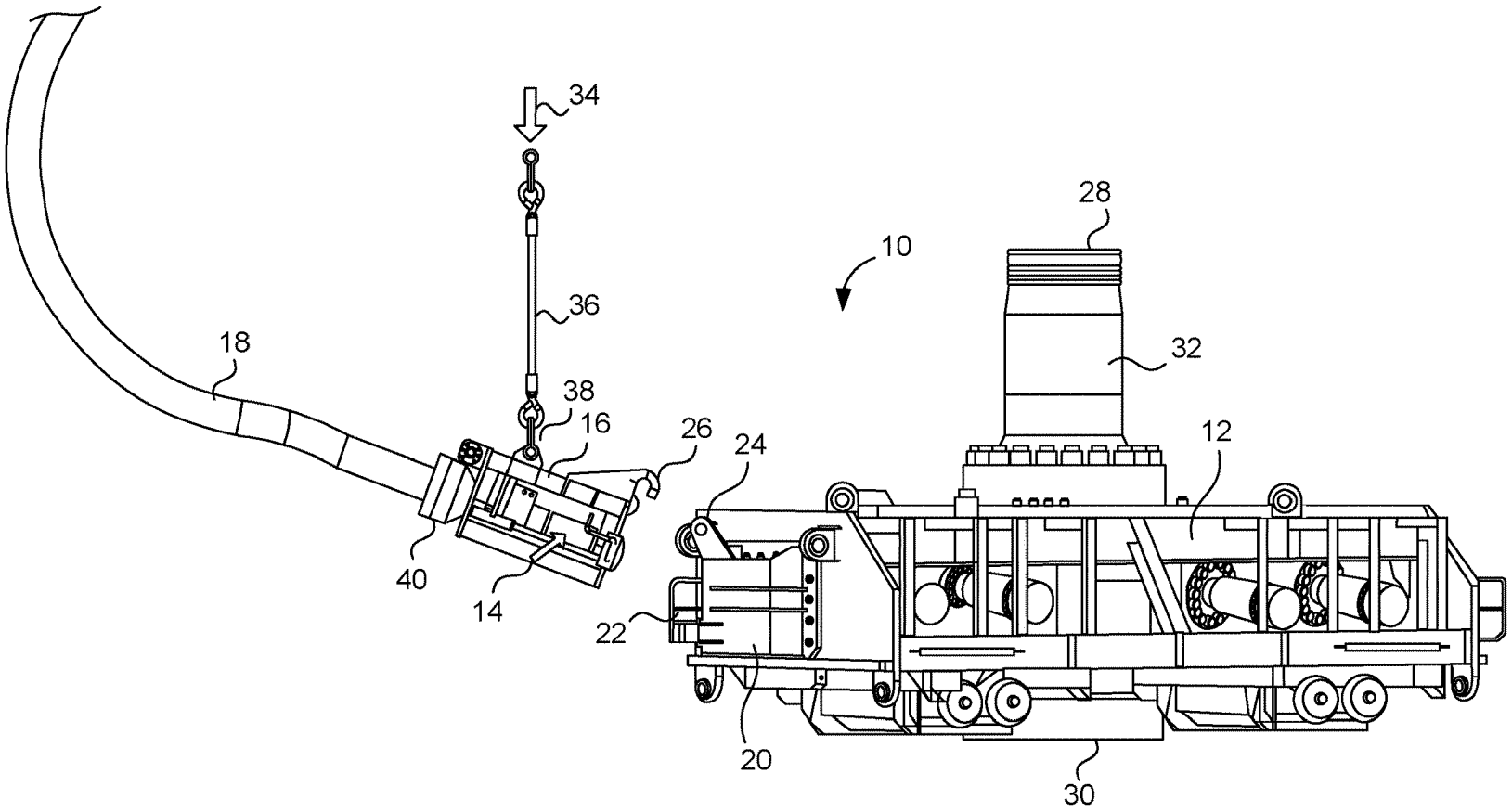
FIG. 1 is a side elevational view of the system of the present invention with the frame and hot stab in proximity to the subsea structure.

Referring to FIG. 1, there is shown the subsea connection system 10 in accordance with teachings of the present invention. The subsea connection system 10 has a subsea structure 12, a stab 14, a frame 16, and a flowline 18 connected to the stab 14. The subsea structure 10 has a flow channel 20 therein. A port 22 is located at one end of the flow channel 20. The subsea structure 12 also has a tool hanger 24 positioned at an outer surface thereof adjacent to the port 22. The stab 14 is adapted to engage the port 22 of the subsea structure 12 so as to allow a fluid to flow from the flowline 18 into the flow channel 20 of the subsea structure 12. The frame 16 is affixed to the stab. The frame 16 has a hook portion 26 that is engageable with the tool hanger 24 of the subsea structure 12 so as to support the stab 14 in alignment with the port 22 of the flow channel 20. As will be described hereinafter, the frame 16 will be pivotable about the tool hanger 24 so as to move the stab 14 toward the port 22.

The system 10 of the present invention is adaptable to a wide variety of subsea structures. In FIG. 1, the subsea structure that is utilized with the system 10 of the present invention is a relief well injection spool. As was described hereinbefore, the relief well injection spool is intended to be attached to a wellhead of a relief well so as to allow for high-volume and high-pressure fluids to flow through the relief well into the bore of a well that is blowing. The relief well injection spool 10 includes a central bore 28 that extends vertically through the relief well injection spool. A wellhead connector 30 is adapted for flanged connection to the relief well wellhead. The flow channel 20 extends horizontally through the relief well injection spool of the subsea structure 12 so as to open to the bore 28. Various valves are utilized on the subsea structure 12 so as to control the flow into the bore 28. The subsea structure 12 has a mandrel 32 extending upwardly there from. Mandrel 32 can be adapted to be connected to the bottom of a blowout preventer.

FIG. 1 illustrates an initial step in the method of the present invention. In particular, there is a downline 34 that extends from a surface location, such as a kill vessel. Tool rigging 36 is connected to the downline 34 and is joined to a shackle 38 on the frame 16. The hot stab 14 is received within the interior of the frame 16 and is affixed thereto. The hot stab 14 will have a connector 40 at an end thereof. Connector 40 allows the hot stab 14 to be connected to the flowline 18. The downline 34 is payed out from the surface location so as to be lowered such that the frame 16 and the stab 14 is in proximity to the subsea structure 12. It can be seen that the hook portion 26 is separate from the tool hanger 24 on the subsea structure 12.

As described herein, the flowline 18 will be a high-volume high-pressure flowline. In particular, so as to allow the relief well injection spool to carry out the necessary delivery of fluids so as to kill the well, the flowline 18 will have an inner diameter of greater than two inches. Preferably, the flowline 18 will have a four inch inner diameter. As such, the stab 14 will be a four inch stab. This stab will have a very large weight. As such, the frame 16 and the stab 14 would be too heavy to be carried and manipulated by a a remotely-operated vehicle. In FIG. 1, it can be seen that the entire weight of the frame 16, the stab 14 and the flowline 18 is supported by the downline 34 and the tool rigging 36 from the surface location.

Figure 2:
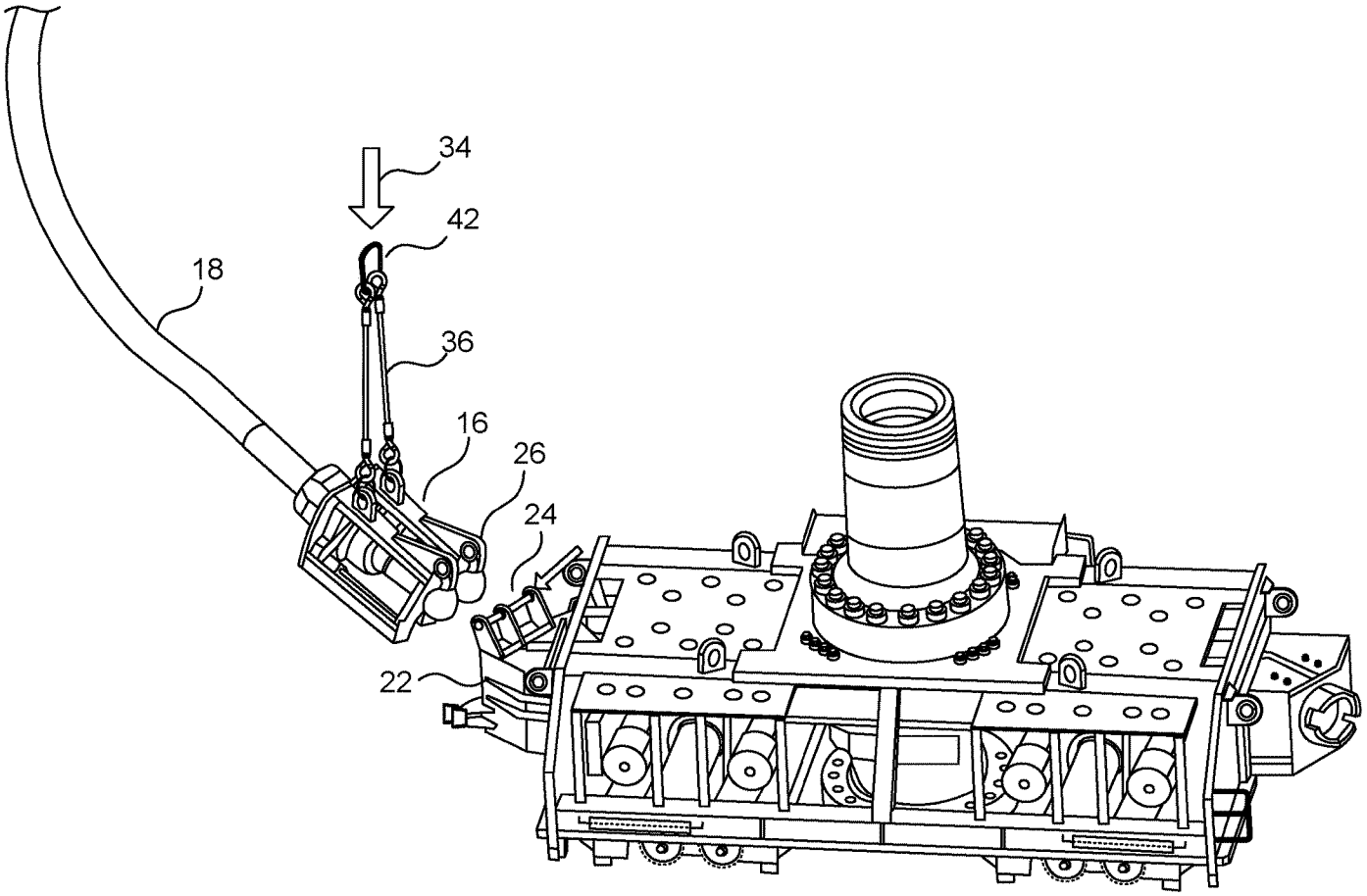
FIG. 2 is a perspective view of the frame and hot stab in proximity to the subsea structure.

FIG. 2 is a perspective view showing that the initial step of the installation of the frame 16 to the tool hanger 24. The tool hanger 24 is in the nature of a rod or bar that extends generally in a horizontal plane above the port 22 of the flow channel. It also extends slightly outwardly beyond the end of the port 22. As such, the tool hanger 24 will be in an appropriate location so as to receive the hook portion 26 of the frame 16. The tool rigging 36 includes first and second cables that are connected to a clevis 42. Clevis 42 can then, in turn, be connected to the downline 34. The flowline 18 extends outwardly from the opposite end of the frame 16 and upwardly toward a surface location or other location having a supply of fluid.

Figure 3:
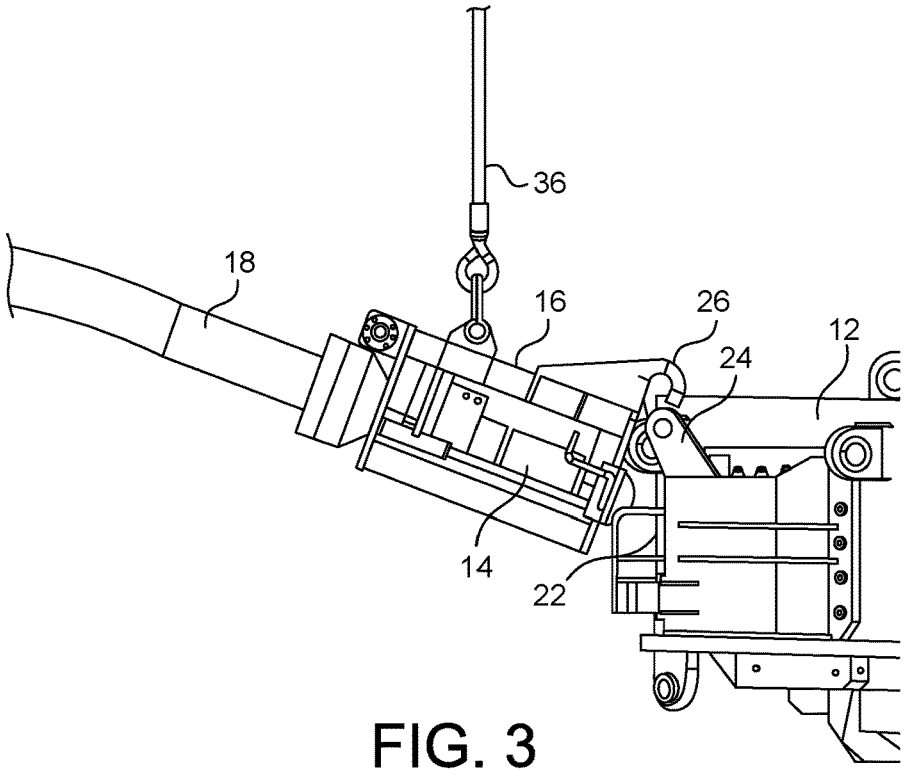
FIG. 3 is a side elevational view showing the placement of the hook portion of the frame with the tool hanger of the subsea structure.

FIG. 3 shows that the frame 16 is still supported by tool rigging 36. An ROV is used so as to move the frame 16 so that the hook portion 26 resides over the tool hanger 24. The hook portion 26 has a semicircular slot therein which has radius suitable for accommodating the diameter of the rod or bar of the tool hanger 24. In this position, the stab 14 is still separate from the port 22 of the subsea structure 12. The frame 16 will extend slightly upwardly at an angle away from the subsea structure 12.

Figure 4:
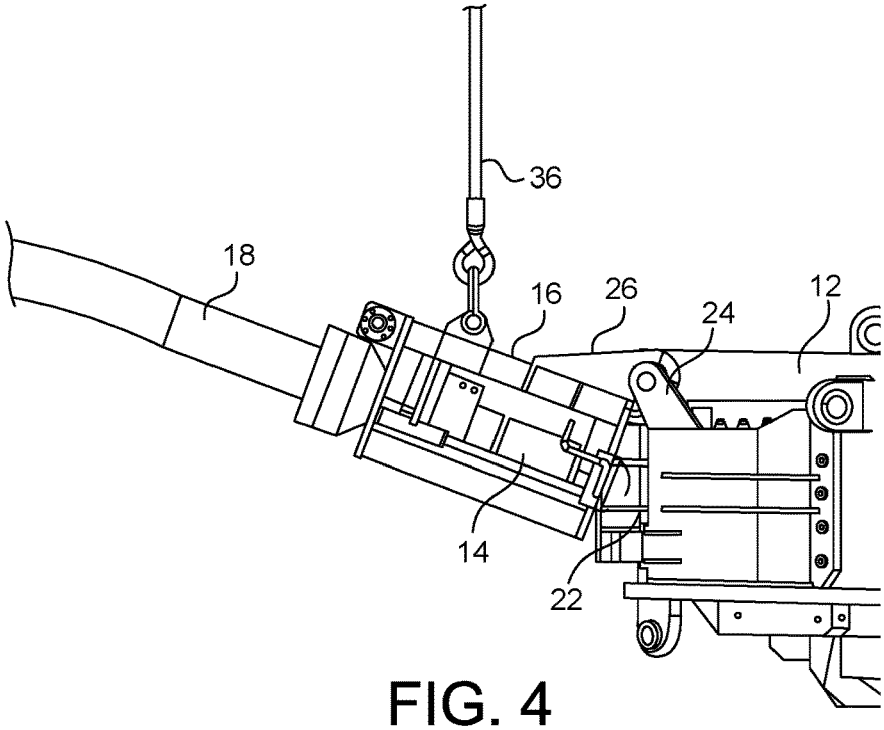
FIG. 4 shows is a side elevational view of an initial step of pivoting the frame with respect to the subsea structure.

FIG. 4 shows that the hook portion 26 has been lowered by the action of the downline 34 and the tool rigging 36 so as to engage with the tool hanger 24. The frame 16 still remains at an upwardly-turned angle away from the port 22 of the subsea structure 12. The stab 14 is in a retracted position within the frame 16 during this operation. As such, the end of the stab 14 will not interfere with the ability to properly installed the hook portion 26 on the tool hanger 24. Throughout the operations shown in FIGS. 3 and 4, virtually the entire weight of the frame 16, the stab 14 and the flowline 18 is supported by the downline 34 and the tool rigging 16.

Figure 5:
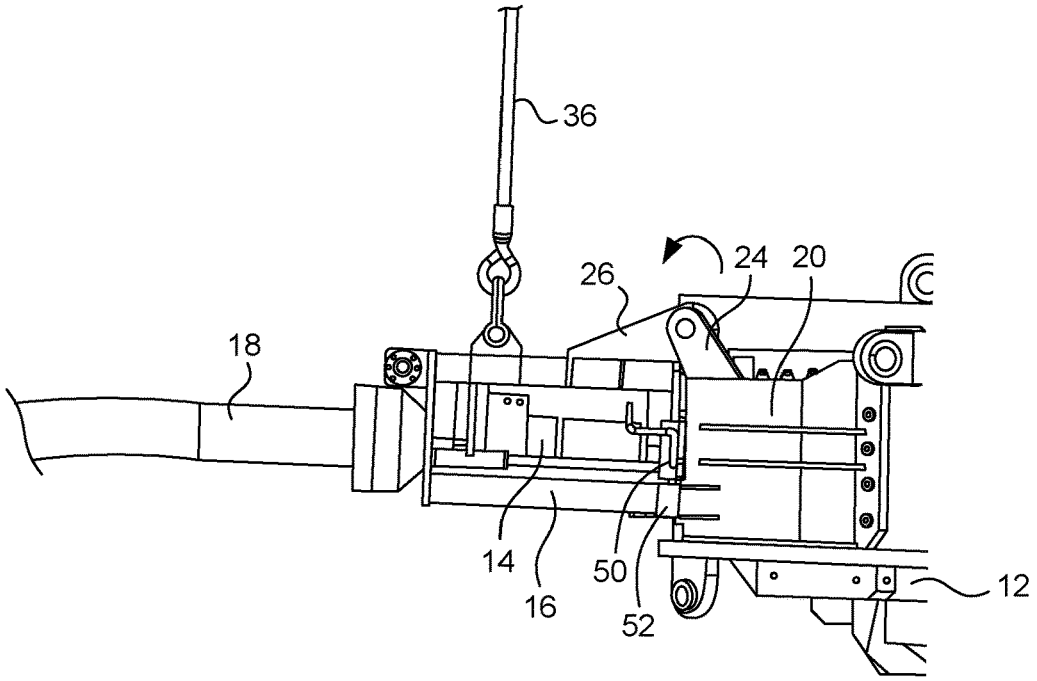
FIG. 5 is a side elevational view of the system of the present invention in which the frame and hot stab have been rotated to a position in which the hot stab is in alignment with the port and flow channel of the subsea structure.

In FIG. 5, the hook portion 26 remains engaged with the tool hanger 24. The tool rigging 36 and the downline 34 are lowered from the surface location by paying out the downline 34. As such, the frame 16 will pivot with respect to the tool hanger 24 so as to be aligned with the flow channel 20 of the subsea structure 12. The flowline 18 will extend outwardly of the frame 16 and the stab 14 in general alignment with the flow channel 20.

FIG. 5 shows that there is a locking member 50 that is provided on the forward end of the frame 16 away from the flowline 18. The locking member 50 is in the nature of a locking pin that is rotatable or pivotable relative to the frame 16. The locking member 50 is aligned with a receptacle 52 on the subsea structure 12. When the hook portion 26 is pivoted relative to the tool hanger 24 and the stab 14 is in alignment with the port 22 of the flow channel 18, the locking member 50 should be aligned with the receptacle 52.

Figure 6:
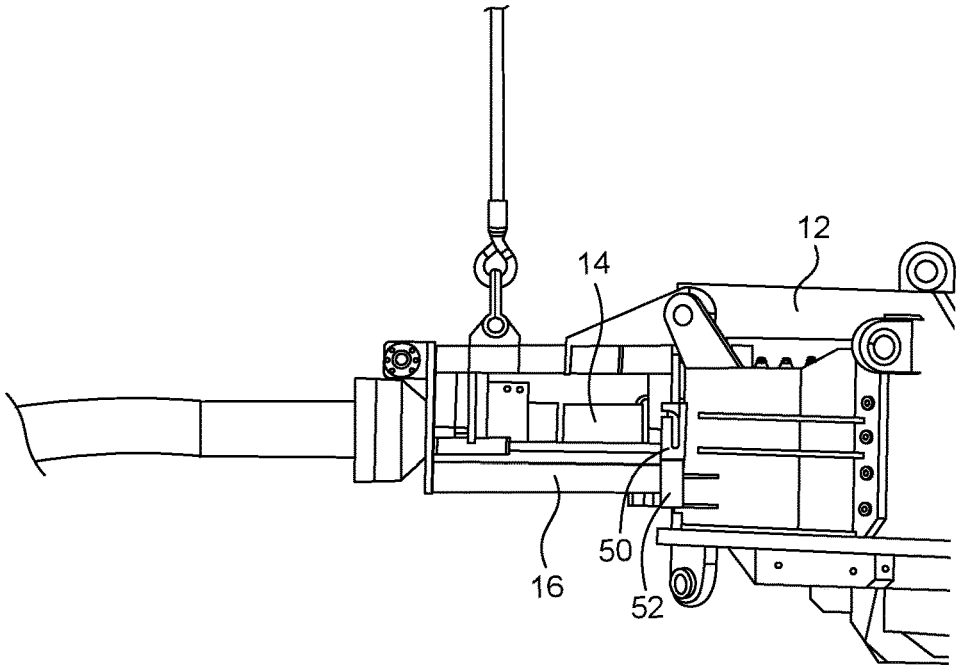
FIG. 6 is a side elevational view of the system of the present invention showing the locking pin in the unlocked position.

FIG. 6 shows that the locking member 50 has been manipulated so as to engage with the receptacle 52 so as to lock the frame 16 in relation to the subsea structure 12. It is important to lock the frame 16 to the subsea structure 12 prior to actuating the stab 14. If it were not locked, then the forces imparted by the stab 14 to the port of the subsea structure 12 would cause the frame 16 and the hot stab 14 to pivot away from the subsea structure 12 and, as such, would establish an improper connection. The locking member 50 can be easily manipulated by a remotely-operated vehicle. In one embodiment, it is only necessary to rotate the locking pin of the locking member so that it is received within the receptacle 52. This arrangement establishes a strong and fixed connection between the frame 16 and the subsea structure 12.

Figure 7:
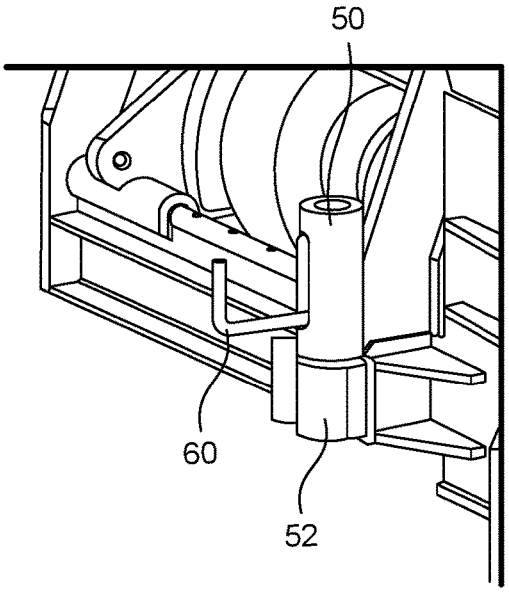
FIG. 7 is a close-up perspective view of the locking pin used to lock the frame to the subsea structure.

FIG. 7 shows a detailed view of the locking member 50 and the receptacle 52. There is an arm 60 that extends outwardly of the locking member 50. Arm 60 can be grasped by the remotely-operated vehicle and rotated so that the locking member 50 engages the receptacle 52. To separate the locking member 50 from the receptacle 52, it is only necessary for the remotely-operated vehicle to rotate the arm 60 in an opposite direction. Once again, the remotely-operated vehicle carries none of the weight of the assembly.

Figure 8:
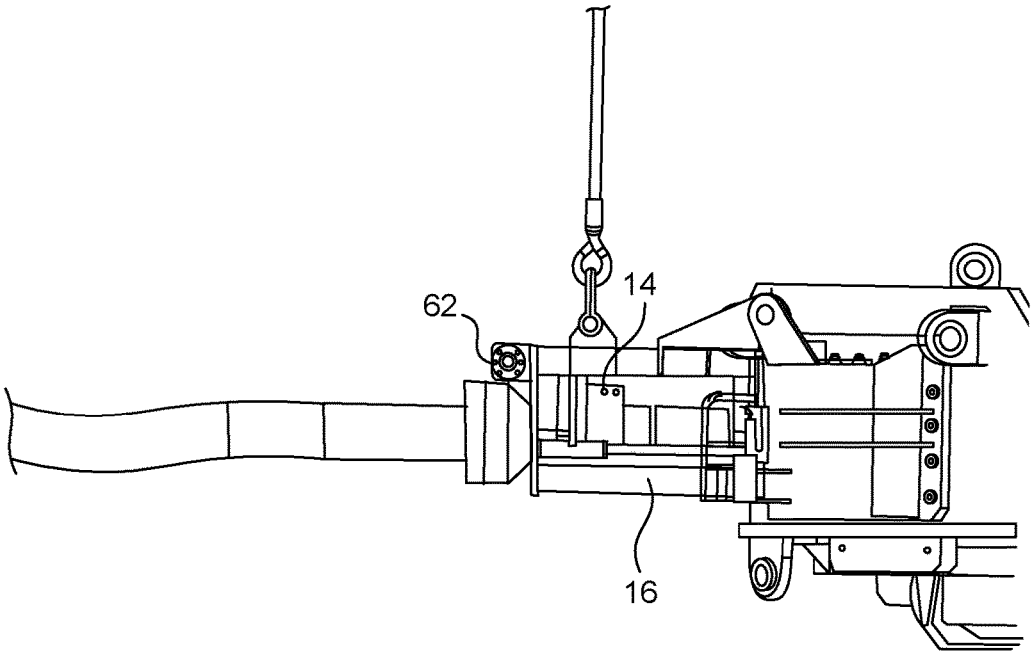
FIG. 8 is a side elevational view of the system of the present invention in which the hot stab is in a retracted position.
Figure 9:
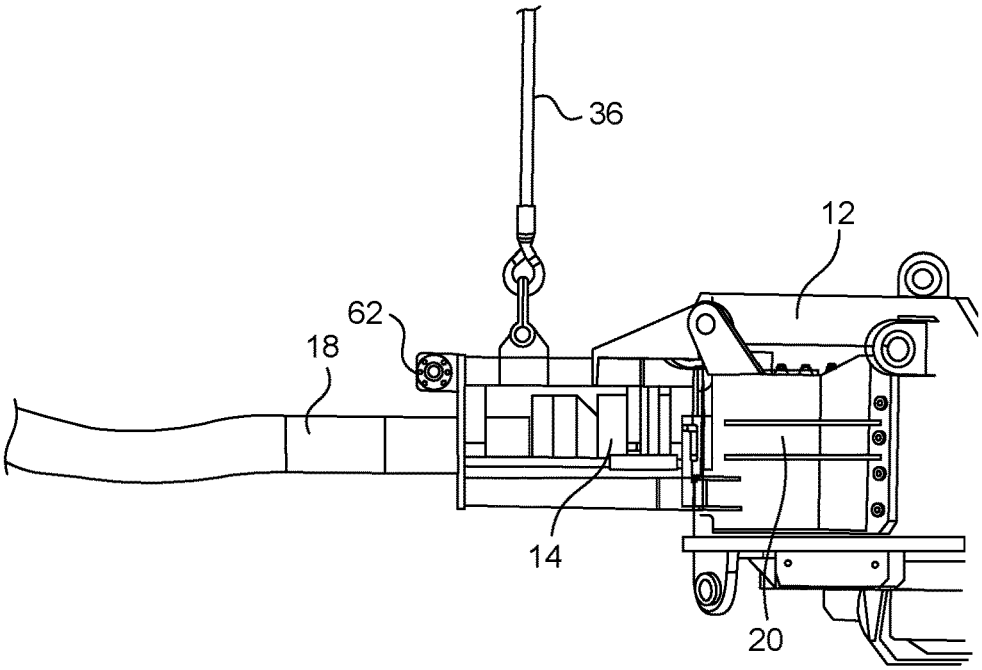
FIG. 9 is a side elevational view of the system of the present invention in which the hot stab is engaged with the port of the flow channel of the subsea structure.

FIG. 8 shows that the stab 14 is in a retracted position within the frame 16. Importantly, there is an actuator 62 that is provided at an end of the frame 60. Actuator 62 is cooperative with the stab 14 so as to move the stab 14 between a retracted position (as shown in FIG. 8) and an extended position (as shown in FIG. 9). Actuator 62 can be a mechanical or hydraulic actuator. In the preferred embodiment of the present invention, the actuator 62 is a hydraulic actuator. As such, an ROV can connect with the actuator 62 so as to inject pressurized hydraulic fluid into the actuator 62. This will cause the stab 14 to move from the retracted position to the extended position. The actuator 62 is a dual port actuator. As such, when hydraulic fluid is injected into one of the ports of the actuator 62, it will move the stab 14 from the retracted position to the extended position. When the hydraulic fluid from the ROV is introduced into the other port of the actuator 62, it will move the stab 14 from the extended position to the retracted position.

FIG. 9 shows that the actuator 62 has been actuated so as to move the stab 14 to the extended position. In this extended position, the stab 14 will engage with the port of the subsea structure 12 so as to establish a fluid connection between the flowline 18 and the flow channel 20 of the subsea structure 12. The actuator 62 will maintain the stab 14 in this extended position so as to withstand any separation forces that might occur. The flowline 18 can then deliver high-volume and high-pressure fluids into the subsea structure 12.

At this stage, the subsea structure 12 can be used for its intended purpose. To the extent that the subsea structure 12 is a relief well injection spool, the flowline 18 can deliver the high pressure high-volume fluids through the relief well injection spool, through the relief well, and into the main bore of the flowing well. When the flowing well has been capped, the stab 14 can be released, the frame 16 can be removed and the entire assembly can be returned to the surface by the downline 34 and the tool rigging 36.

Figure 10:
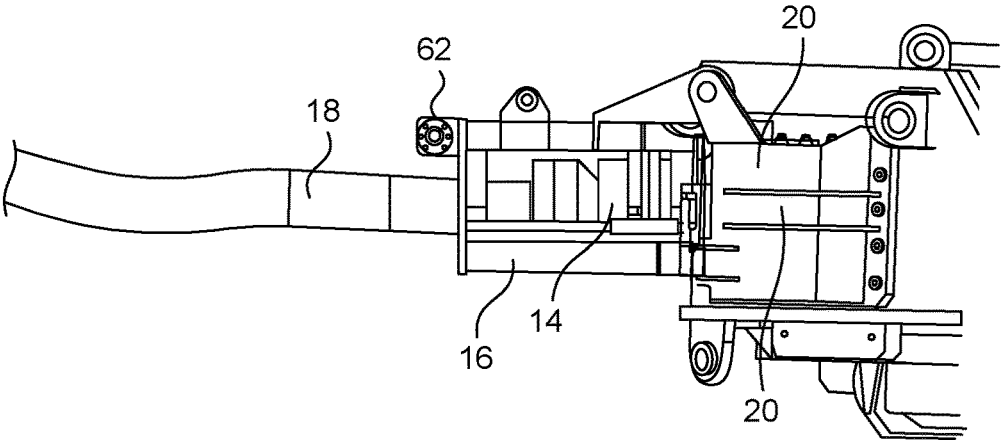
FIG. 10 is a side elevational view showing the step of separating the hot stab from the port of the subsea structure.

FIG. 10 shows the initial step of the separation procedure. In FIG. 10, the actuator 62 has been actuated so as to separate the stab 14 from its engagement with the port 22 of the flow channel 20. The tool rigging 36 and the downline 34 can be lifted upwardly so as to return the frame 16, the stab 14 and the flowline 18 to a surface location for reuse elsewhere.

It should be noted that in the installation of the system of the present invention, the connection between the hot stab and the subsea structure is accomplished through the use of gravity. Gravity will encourage they frame and the stab to rotate downwardly with respect to the tool hanger. The downline 34 and the tool rigging 36 will, at all times, support the weight of the assembly. The remotely-operated vehicle is only utilized for the purposes of fine manipulation and for actuation. The remotely-operated vehicle simply moves the supported weight of the assembly to its proper position at the tool hanger. The downline will continue to be played out until the downline becomes slack. Once the downline become slack, it is assured that the frame 16 has pivoted through its entire range of motion so as to be in alignment with the flow channel 20 of the subsea structure 12.

It should be noted that the flowlines having an inner diameter of two inches or less can be manipulated by a conventional remotely-operated vehicle. Additionally, the weight of such a hot stab on such small flowlines can be supported by the remotely-operated vehicle. As such, with conventional flowlines, it would not be necessary to use the frame assembly, the tool hanger, and actuators of the present invention. Since the present invention deals with flowlines having a diameter of greater than two inches and, in particular, an inner diameter of four inches, the present invention is able to establish a quick and easy deployment of such large flowlines in a secure and safe manner. As such, in the event of a well blowout, the relief well injection spool, along with the high volume, high-pressure flowline can be installed out with maximum efficiency.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A subsea connection system comprising:

a subsea structure having a flow channel therein, said flow channel having a port adjacent one end thereof, said subsea structure having a tool hanger positioned on an outer surface thereof adjacent said port, said tool hanger extending longitudinally outwardly beyond an end of said port;

a stab having a flowline connected thereto, said stab adapted to engage said port of said subsea structure so as to allow a fluid to flow from said flowline into said flow channel of said subsea structure;

a frame affixed to said stab, said frame being a fixed structure, said frame having a fixed hook portion that is engageable with said tool hanger of said subsea structure so as to support said stab in horizontal alignment with said port of said flow channel, said fixed hook portion positioned above said frame and positioned longitudinally outwardly beyond an end of said frame, said fixed hook portion being pivotable around said tool hanger so as to move said stab into horizontal alignment with said port;

a hydraulic actuator cooperative with said stab so as to move said stab interior of said frame between a retracted position and an extended position, the extended position connecting said stab to said port;

a lock member affixed to said frame, said lock member engageable with said subsea structure so as to fix a position of said frame with respect to said port of said subsea structure, said lock member having a receptacle on one of said frame and said subsea structure and a pin on the other of said frame and said subsea structure, said pin being rotatable so as to engage said receptacle, said pin having an arm extending outwardly therefrom and outwardly of said frame or said subsea structure, said arm adapted to be manipulated by a remotely operated vehicle so as to rotate said pin.

2. A method of connecting a stab to a port of a flow channel of a subsea structure, the stab being received interior of a frame, the frame having a fixed hook positioned longitudinally outwardly beyond an end of said frame, the frame being a fixed structure, the stab having a flowline connected thereto, the subsea structure having a tool hanger extending longitudinally outwardly beyond the port, the method comprising:

lowering the frame and the stab toward the subsea structure;

moving the frame so that the fixed hook engages the tool hanger;

pivoting the fixed hook around the tool hanger such that the stab is in horizontal alignment with and in proximity to the port of the subsea structure; and locking the frame to the subsea structure, the step of locking comprising:

engaging an arm extending outwardly of a locking pin on the frame with an arm of a remotely-operated vehicle (ROV); and moving the arm with the arm of the ROV so as to rotate the locking pin such that the locking pin engages with a receptacle on the subsea structure;

actuating the stab within the frame so that the stab moves horizontally from a retracted position to an extended position relative to the fixed structure of the so as to establish a fluid connection between the flowline and the flow channel.

3. The method of claim 2, the step of actuating comprising:

connecting the remotely-operated vehicle to a hydraulic actuator, the hydraulic actuator being affixed to the frame and cooperative with the stab; and flowing hydraulic fluid from the remotely-operated vehicle to the hydraulic actuator so as to move the stab from the retracted position to the extended position.

4. The method of claim 2, the frame being connected to a line, the step of lowering comprising:

paying out the line from a surface location until the frame and the stab are in proximity to the subsea structure.

5. The method of claim 4, the step of pivoting comprising:

further paying out the line from the surface location until the line becomes slack.

6. The method of claim 2, further comprising:

connecting the flowline to the stab so as to establish a fluid connection between the flowline and the stab, the flowline having an inner diameter greater than two inches.

7. The method of claim 2, further comprising:

flowing a fluid through the flowline and through the stab into the flow channel of the subsea structure.

8. The method of claim 2, further comprising:

retracting the stab within the frame so as to separate the stab from the port of the subsea structure;

unlocking the frame from the subsea structure; and raising the frame and the stab toward a surface location.

* * * * *